US010001333B1

(12) United States Patent
Heizer et al.

(10) Patent No.: US 10,001,333 B1
(45) Date of Patent: Jun. 19, 2018

(54) BARREL LATCH SAFETY PIN

(71) Applicant: Heizer Defense, LLC, Pevely, MO (US)

(72) Inventors: Charles K. Heizer, St. Louis, MO (US); Thomas C. Heizer, St. Louis, MO (US); Hedy H. Gahn, St. Louis, MO (US)

(73) Assignee: Heizer Defense, LLC, Pevely, MO (US)

( * ) Notice: Subject to any disclaimer, the term of this patent is extended or adjusted under 35 U.S.C. 154(b) by 0 days. days.

(21) Appl. No.: 15/375,262

(22) Filed: Dec. 12, 2016

Related U.S. Application Data

(63) Continuation of application No. 15/148,064, filed on May 6, 2016, now Pat. No. 9,518,791, which is a continuation of application No. 14/949,873, filed on Nov. 23, 2015, now Pat. No. 9,335,110.

(60) Provisional application No. 62/083,187, filed on Nov. 22, 2014.

(51) Int. Cl.

| | |
|---|---|
| ***F41C 3/16*** | (2006.01) |
| ***F41A 17/50*** | (2006.01) |
| ***F41A 19/10*** | (2006.01) |
| ***F41C 3/00*** | (2006.01) |
| ***F41A 19/41*** | (2006.01) |

(52) U.S. Cl.
CPC ..... *F41A 17/50* (2013.01); *F41A 19/10* (2013.01); *F41A 19/41* (2013.01); *F41C 3/00* (2013.01)

(58) Field of Classification Search
CPC ..... F41C 3/16; F41A 17/50
USPC ..... 42/8, 44, 40, 69.01
See application file for complete search history.

(56) References Cited

U.S. PATENT DOCUMENTS

| | | | | |
|---|---|---|---|---|
| 27,399 | A | 3/1860 | Wampler | |
| 893,465 | A | 7/1908 | Durham | |
| 1,521,286 | A | 12/1924 | Fisher | |
| 1,562,501 | A | 11/1925 | Frommer | |
| 3,561,149 | A | 2/1971 | Center | |
| 4,156,980 | A | 6/1979 | Aspenwell | |
| 4,392,320 | A | 7/1983 | Hillberg | |
| 4,407,085 | A | 10/1983 | Hillberg | |
| 4,662,097 | A | 5/1987 | Walker | |
| 4,722,148 | A | 2/1988 | Walker | |
| 4,914,845 | A | 4/1990 | Reese | |
| 5,050,481 | A | 9/1991 | Knight, Jr. | |
| 5,165,383 | A | 11/1992 | Ebert | |
| 6,655,065 | B1 | 12/2003 | Chapman | |
| 8,495,831 | B1 | 7/2013 | Kohout | |
| 2015/0253097 | A1* | 9/2015 | Kohout | F41A 19/21 42/8 |

* cited by examiner

*Primary Examiner* — Reginald Tillman, Jr.
(74) *Attorney, Agent, or Firm* — Creativenture Law, LLC; Dennis JM Donahue, III

(57) ABSTRACT

A safety pin locks a barrel latch while the firearm discharges a round of ammunition. The barrel latch safety locking mechanism is incorporated into the frame and is actuated by the trigger assembly. The barrel latch safety locking mechanism engages the barrel latch to prevent movement during firing keeping the barrel latch engaged with the barrel. The firearm is further comprised of a slide switch that is connected to the barrel latch that allows a user to disengage the barrel latch for loading.

20 Claims, 9 Drawing Sheets

BARREL LATCH SAFETY PIN

CROSS-REFERENCE TO RELATED APPLICATIONS

This application is a continuation of U.S. patent application Ser. No. 15/148,064 filed on May 6, 2016, issued as U.S. Pat. No. 9,518,791, which is a continuation of U.S. patent application Ser. No. 14/949,873 filed on Nov. 23, 2015 and issued as U.S. Pat. No. 9,335,110, which claims priority to U.S. Provisional Patent Application No. 62/083,187 filed on Nov. 22, 2014, and all priority applications are hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to trigger assemblies, and more particularly to a trigger assembly for a breech loading firearm having a safety pin for locking a barrel latch while the firearm discharges a round of ammunition.

Related Art

There are many different trigger mechanisms that have been created for various firearms, including breech-loading firearms in which the barrel rotates relative to the frame such as in derringer-style pistols, most revolvers and shotguns, and some hunting rifles. Most of these firearms use the standard trigger design which rotates around a pivot point where the top portion of the trigger connects to the frame while some of the firearms use a reciprocating or sliding trigger design which translates within the frame and trigger guard. Many sliding triggers are elongated so that the longitudinal axis of the trigger is parallel to the trigger's reciprocating motion or direction of travel.

The firearms with a rotating barrel have a catch to lock the barrel in the firing position and a release to allow the barrel to rotate into the loading position, and some of these firearms include a secondary latch or other mechanism to ensure that the barrel does not accidentally rotate out of the firing position while the gun is being discharged. For example, U.S. Pat. No. 27,399 discloses a rotatable trigger guard and a bar with a pair of catches which operate together to prevent the accidental rotation of the barrel. The trigger guard is connected to an inner arm that rotates the barrel between the firing and loading positions, and the bar has a catch on one end to latch the breech of the barrel in the firing position and a secondary catch at the opposite end which is latched by a notch in the rotatable trigger guard. In order to rotate the barrel into the loading position, the catch and secondary catch are released, and the trigger guard must then be rotated downwardly so that the inner arm is moved upwardly with the barrel. Another example of a device to prevent the accidental rotation of the barrel is described by U.S. Pat. No. 3,561,149. According to the '149 Patent, a bolt engages a latching recess in the receiver to lock the barrel in the firing position, and the horn of the trigger guard is moved upwardly to unlock the bolt from the latching recess while simultaneously sliding a safety between the hammer and the receiver to prevent an accidental firing. The horn must be moved to its full upward position in order for the trigger to engage a bar that connects to the sear, and without this engagement between the trigger and the bar, it is not possible to cock the hammer for firing. Both of these barrel locking designs are rather complicated because they require the actuation of additional structural elements other than the trigger. Accordingly, it would be beneficial to provide a barrel locking mechanism which engages when the barrel is closed and has a secondary locking mechanism that is actuated by the trigger itself.

There are also devices that use the trigger to unlock the barrel lock, such as described in U.S. Pat. No. 4,662,097, or that prevent the trigger from moving to the firing position by engaging the trigger when the barrel assembly is out of the firing position, such as described in U.S. Pat. No. 5,165,383, but these devices are not a secondary locking mechanism. Additional barrel locking mechanisms are described in U.S. Pat. Nos. 893,465, 1,562,501, 4,156,980, 4,914,845, and 6,655,065.

SUMMARY OF THE INVENTION

In one aspect of the present invention, a safety pin locks a barrel latch while the firearm discharges a round of ammunition. The barrel latch safety locking mechanism is actuated by the trigger pull.

In another aspect of the invention, roller bearings are incorporated into an elongated trigger assembly of a firearm to provide a trigger pull with smooth operation and balance while reducing wear.

In another aspect of the present invention, an extractor assembly for rimless shells is incorporated into a barrel assembly of a breech loading firearm.

The aspects of the present invention as summarized above can be used together or may be used apart from each other in various firearms.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1A:
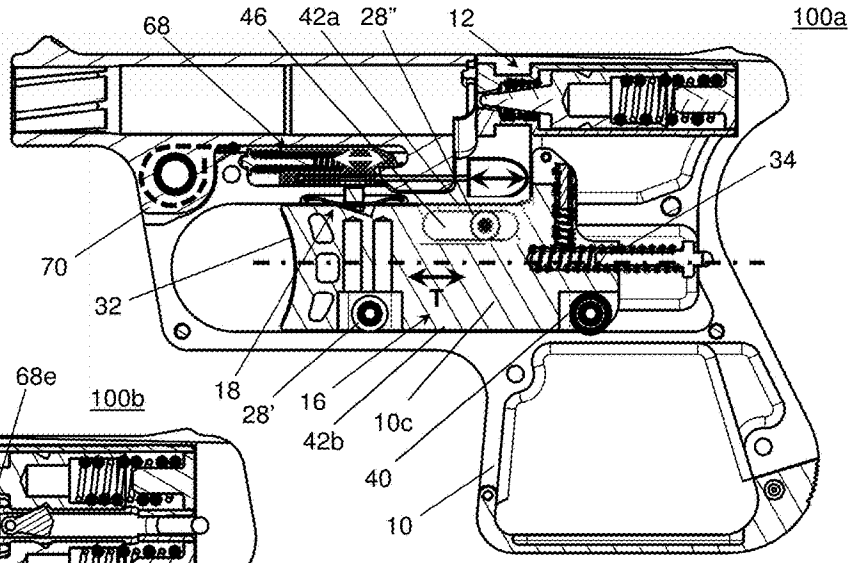
FIGS. 1A and 1B are cross-sectional views of a firearm with the elongated trigger assembly with a roller bearing support and barrel locking mechanism in a single barrel pistol and a double-barrel pistol, respectively.
Figure 1B:
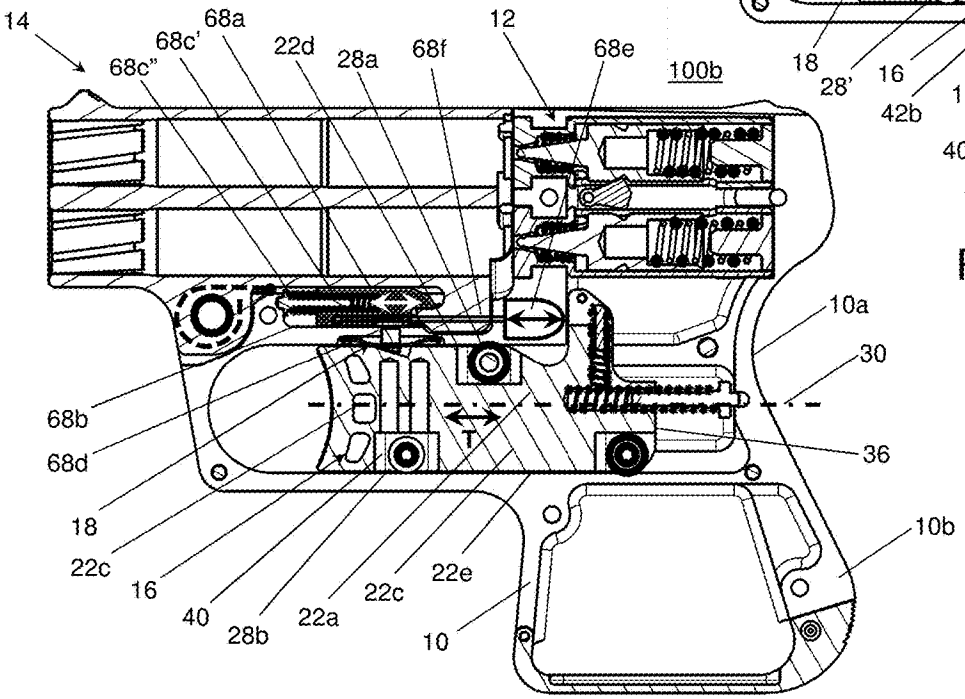
Figure 4:
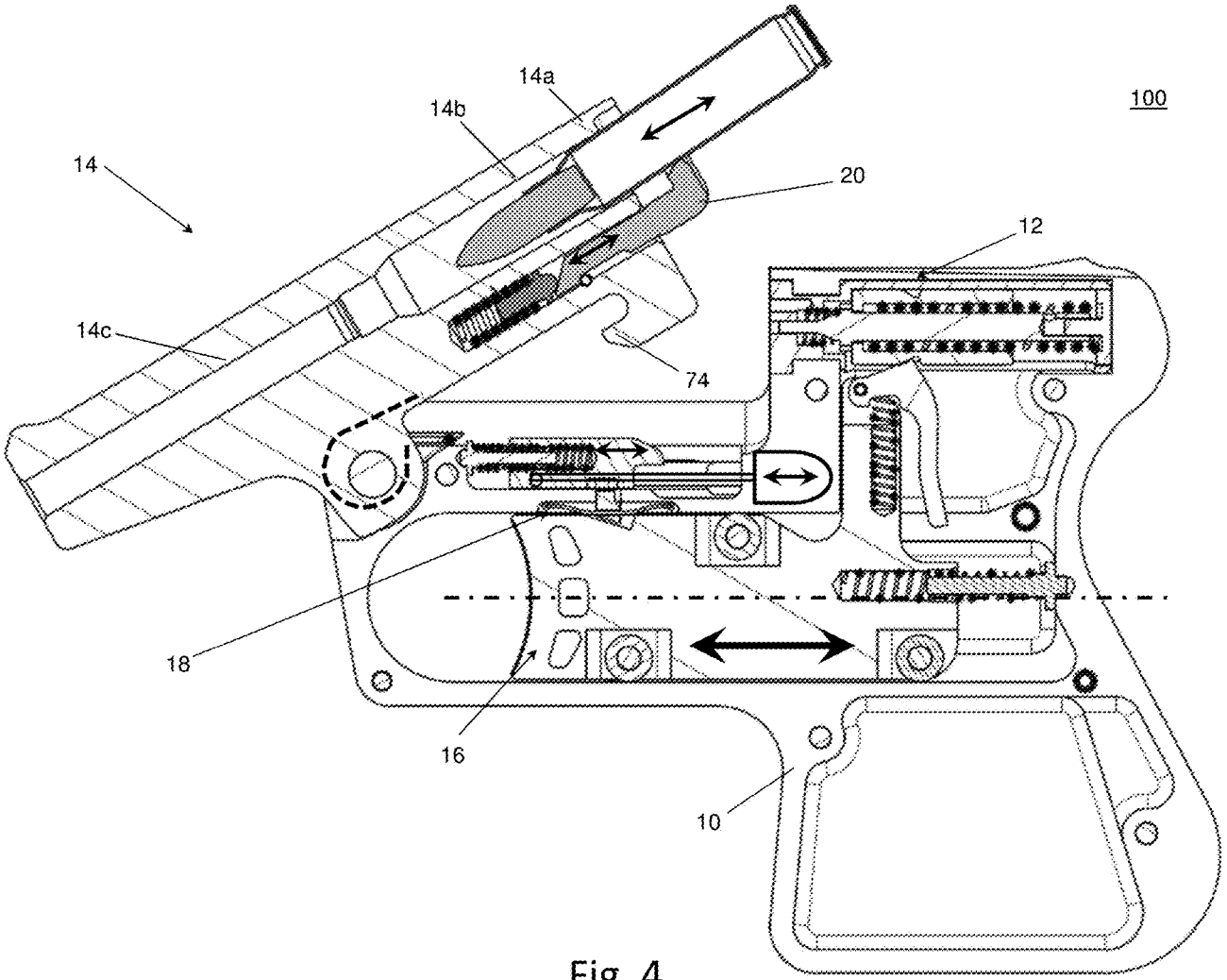
FIG. 4 is a cross-sectional view of the elongated trigger assembly with an alternative barrel in an open-barrel loading orientation.

The following description of the preferred embodiment(s) is merely exemplary in nature and is in no way intended to limit the invention, its application, or uses. According to the invention described in detail below and shown in the accompanying drawings, a firearm 100 may have a single barrel configuration 100*a* or a multiple barrel configuration as shown in FIGS. 1A and 1B, respectively. Generally, as shown in FIGS. 1-4, the firearm 100 has a frame 10, a firing assembly 12, a barrel assembly 14, and a trigger assembly 16. The firearm preferably includes a barrel latch safety locking mechanism 18. Additionally, some embodiments of the firearm may have an optional extractor assembly 20, such as shown in FIGS. 3-4.

Elongated Reciprocating Trigger Assembly with Roller Bearings

The trigger assembly 16 of the present invention is fixed within the frame 10 and preferably has an elongated trigger pull 22 that has a length 24 which is longer that the height 26 of the pull. In addition to the elongated trigger pull, the trigger assembly has a roller bearing mechanism 28. The elongated trigger pull has a longitudinal axis 30 that extends between the front of the trigger shoe 32 to the trigger return 34 at the back surface 36 of the trigger pull in the back of the frame which forms the butt end 10*a* and handle 10*b* of the pistol 100. The longitudinal axis is parallel to the reciprocating direction of travel of the trigger pull (T). The roller bearing mechanism has at least one upper roller bearing 28*a* positioned at the top side or within the upper portion 22*a* of the trigger pull above a centerline 22*b* of the trigger pull, and at least one lower roller bearing 28*b* positioned at the bottom side or within the lower portion 22*c* of the trigger pull below the centerline 22*b*. The roller bearing mechanisms 28 engage tracks 38 on which the outer surface of the roller bearings rotate and which constrain the trigger pull to the reciprocating motion. The trigger pull is positioned between the frame's side faces 10*c*.

Figure 2A:
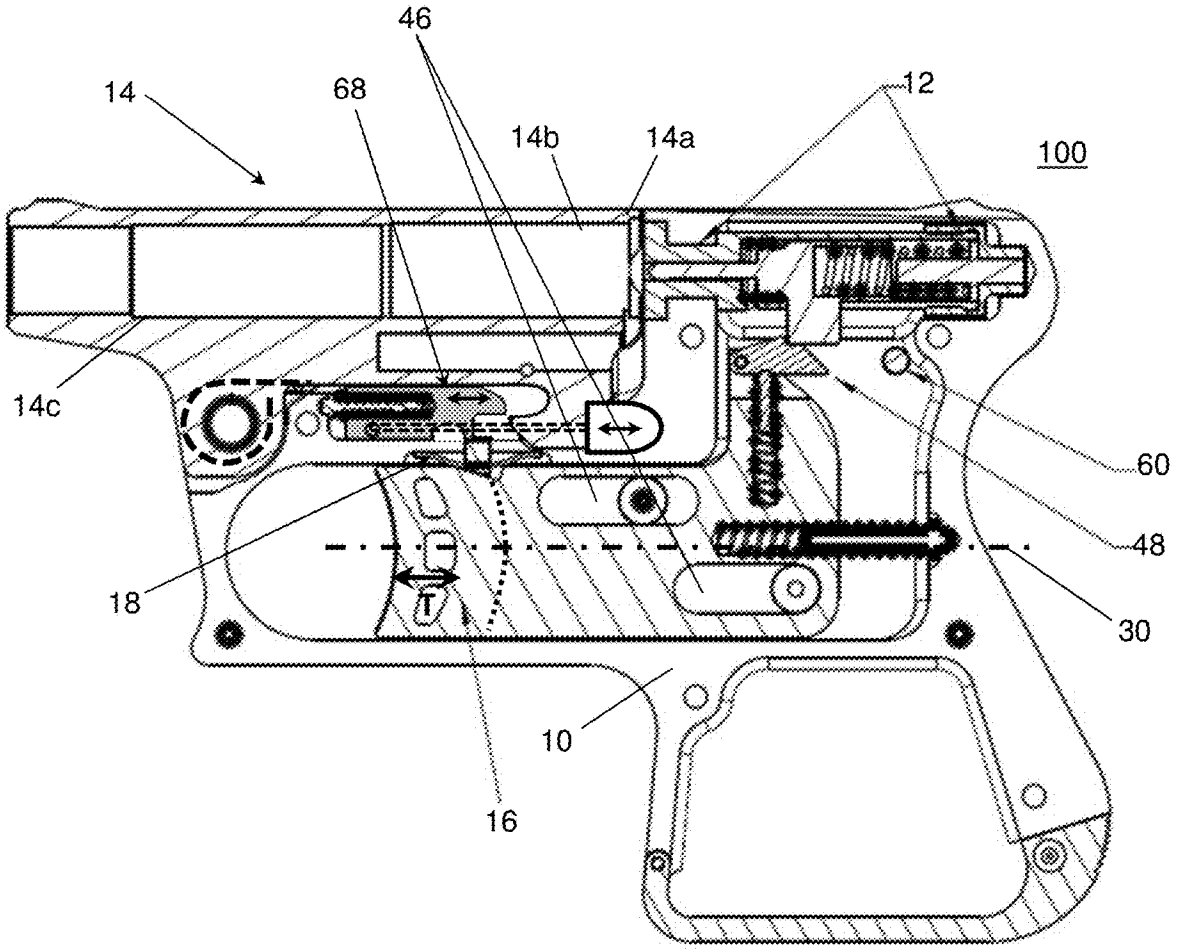
FIGS. 2A and 2B are cross-sectional views of the elongated trigger assembly with an alternative roller bearing support and illustrating the barrel latch safety locking assembly with the barrel lock safety pin and the barrel latch in their disengaged positions and engaged positions, respectively.
Figure 2B:
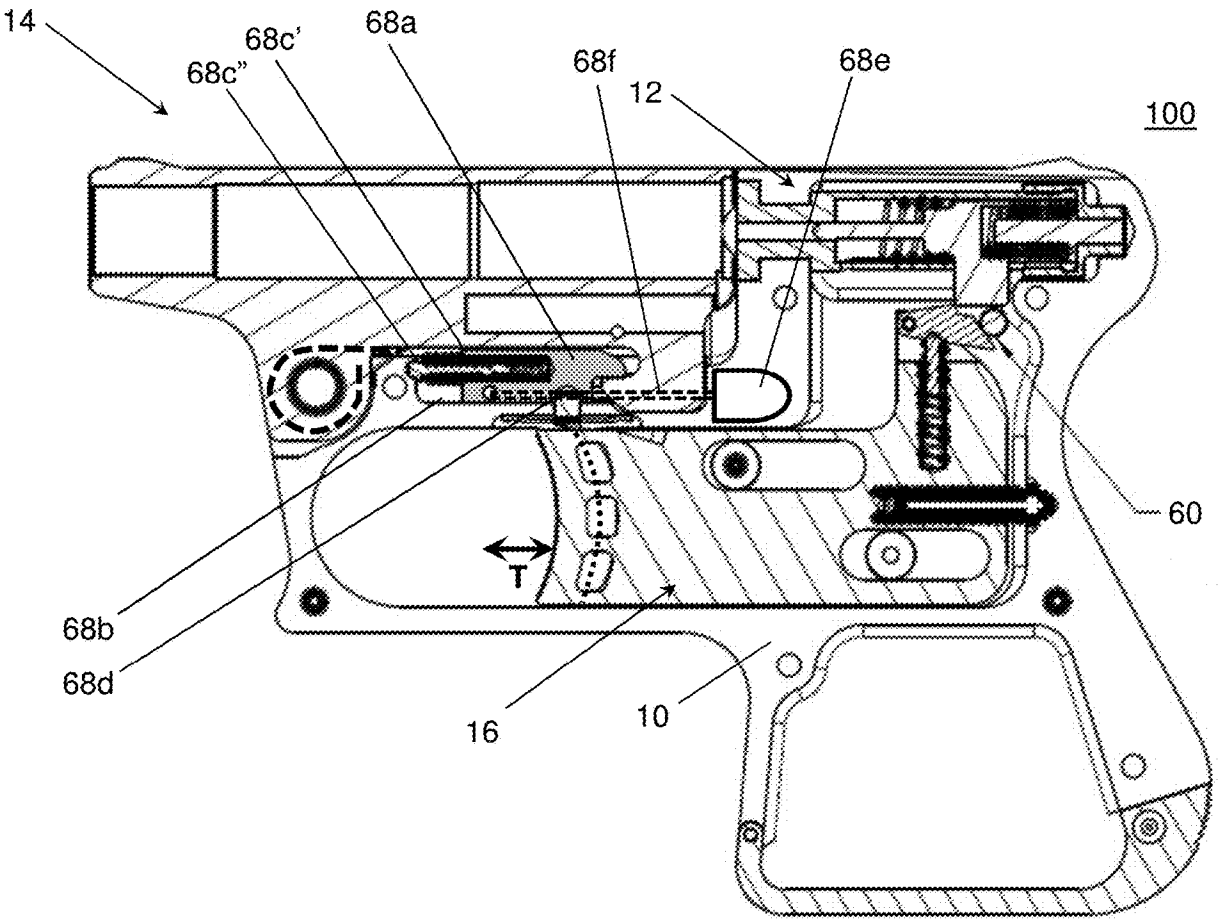
Figure 3A:
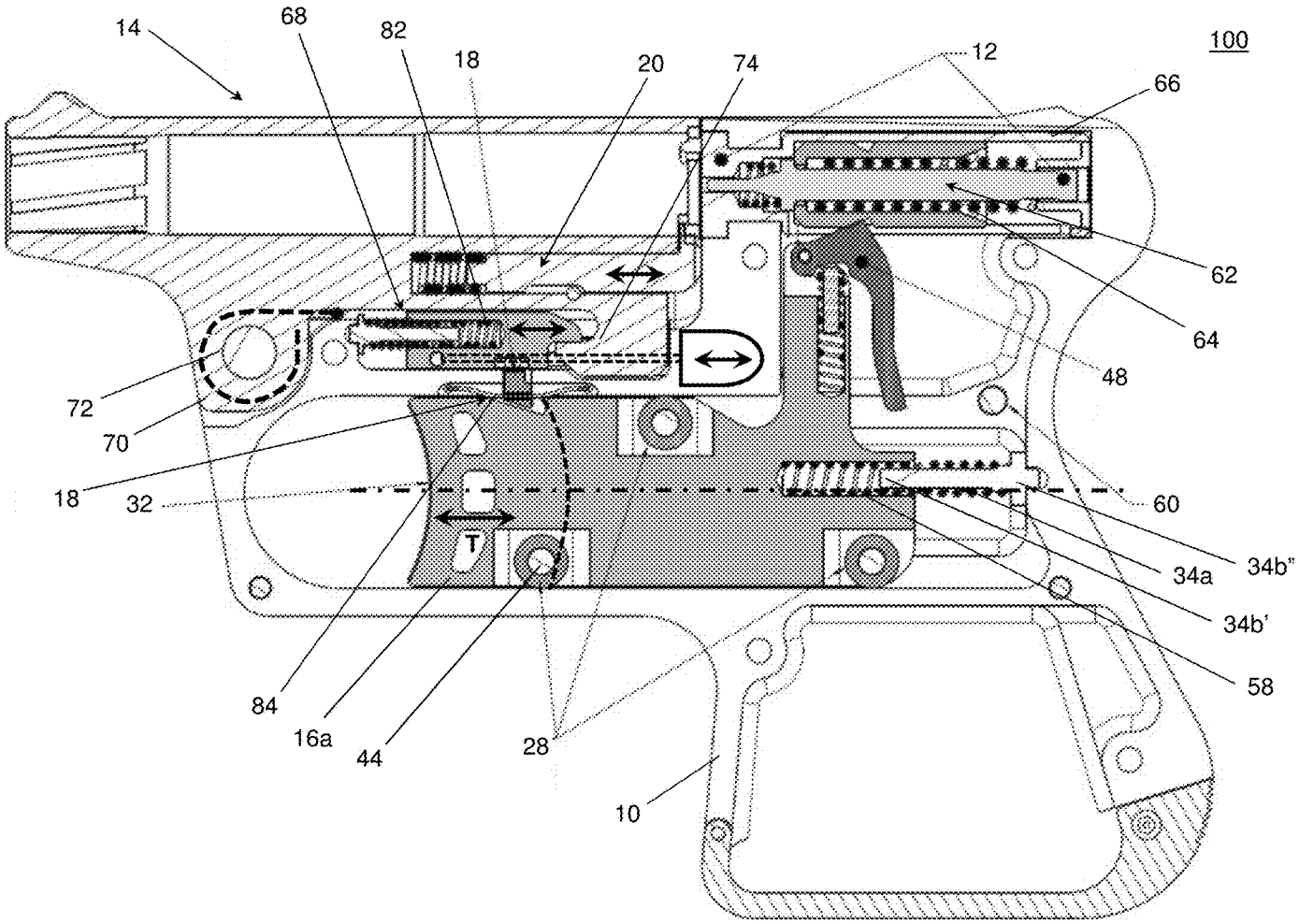
FIGS. 3A-3E are cross-sectional views of the elongated trigger assembly shown in FIG. 1A as the trigger and firing system progress through a firing sequence.
Figure 3B:
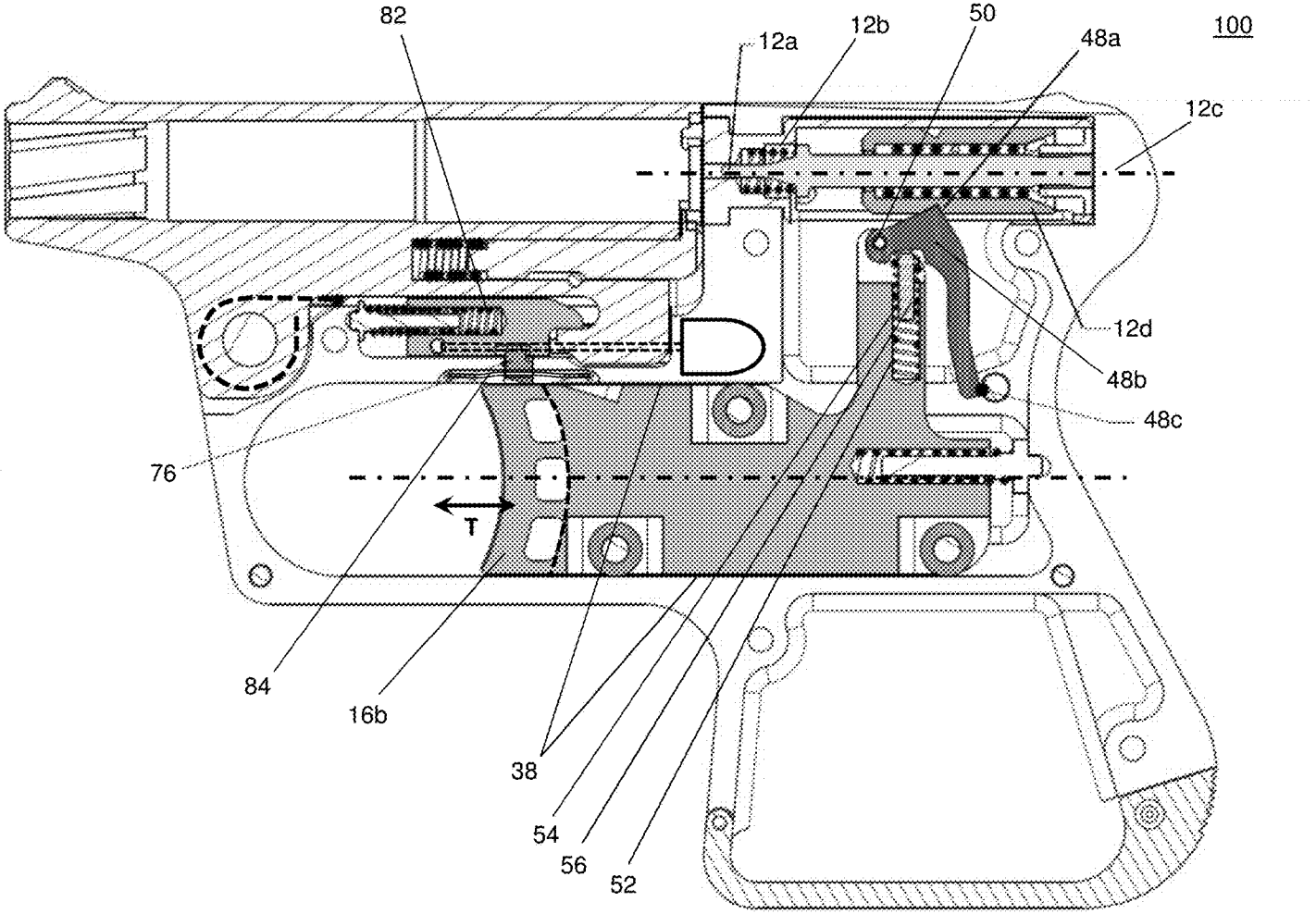
Figure 3C:
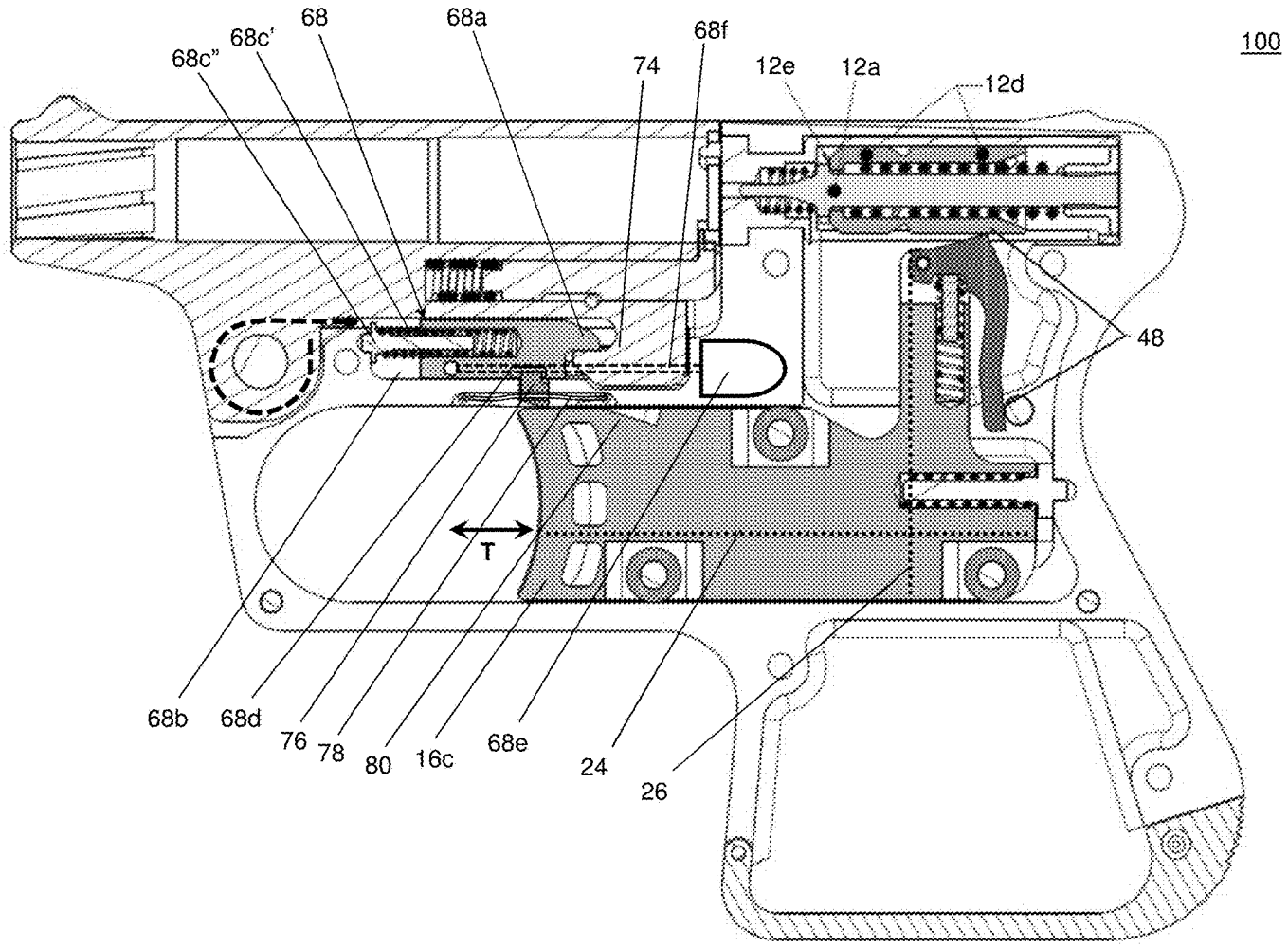
Figure 3D:
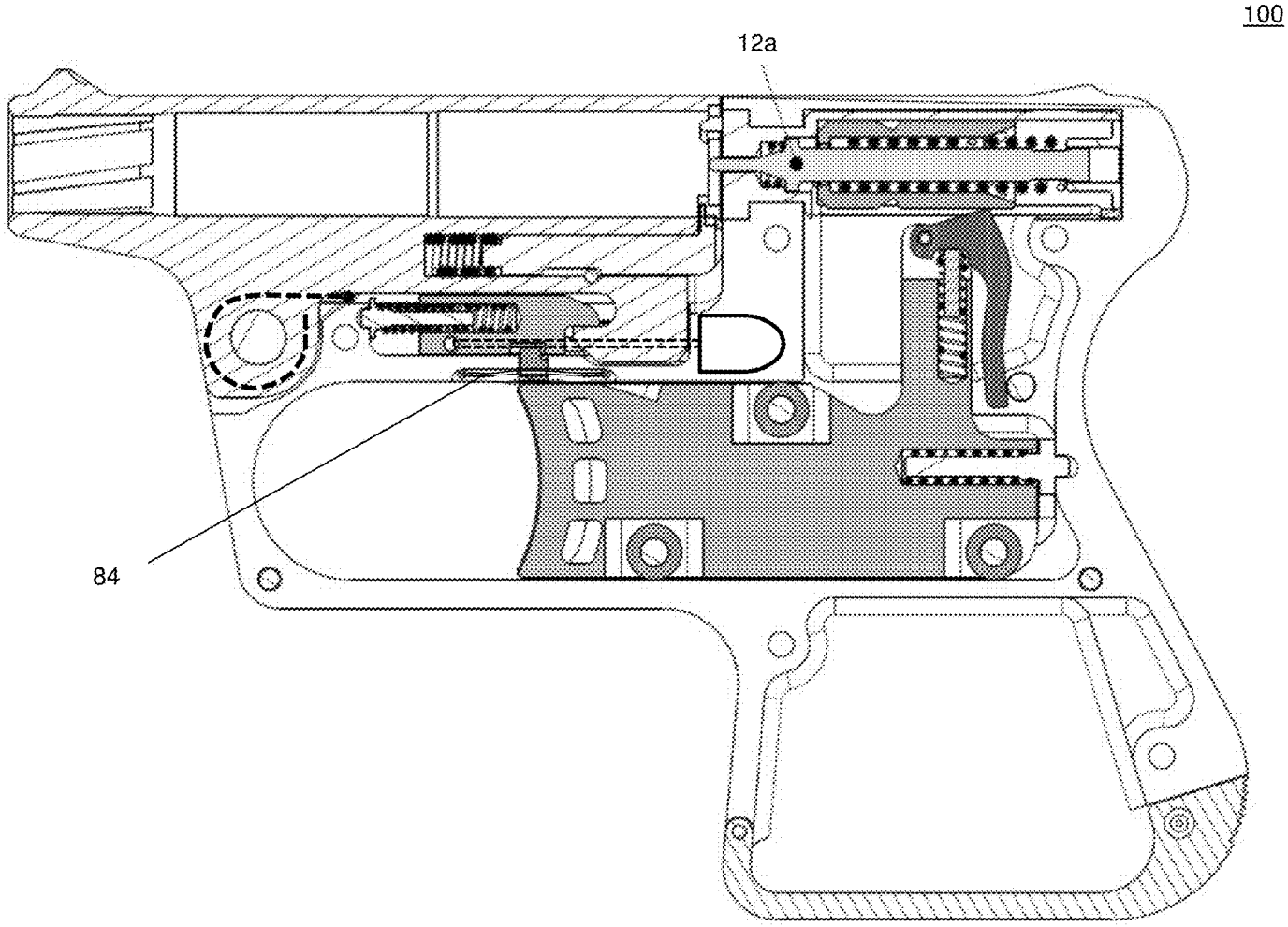
Figure 3E:
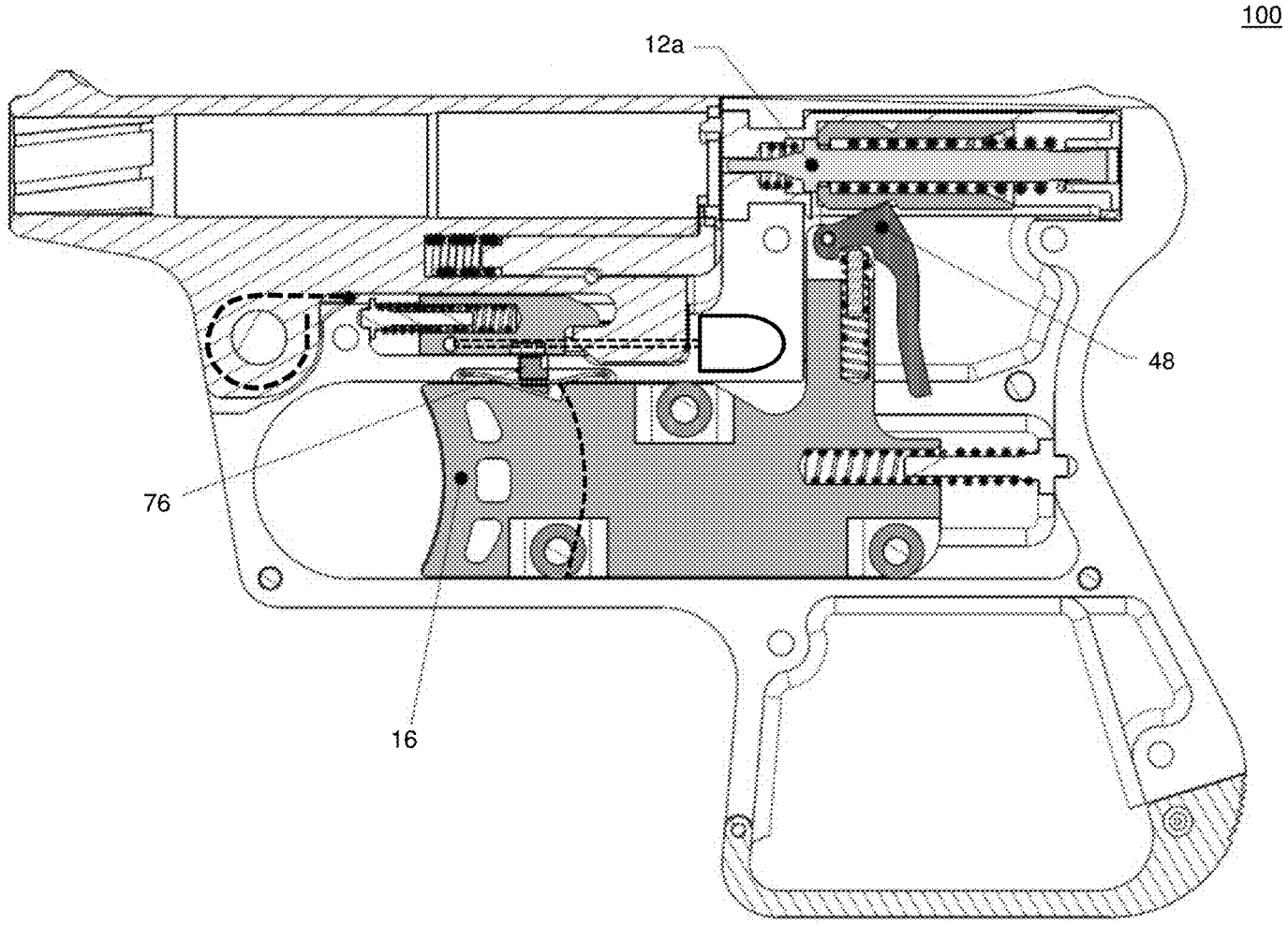

As illustrated in FIGS. 1, 3 and 4, the roller bearings can be positioned in the trigger pull within laterally-spaced upper and lower cavities 40*a*, 40*b* that are respectively open at the top side 22*d* and bottom side 22*e* of the trigger pull so that the bearings can engage and roll along fixed surfaces 42 adjacent to the top and bottom of the trigger pull. The fixed surfaces are preferably the upper and lower sides of the frame that enclose the trigger pull. In these embodiments, the roller bearings 28 are connected to the trigger pull, i.e., trigger-mounted roller bearings 28', such as through a spindle 44, and they move with the trigger pull 22 relative to the frame's upper and lower surfaces 42*a*, 42*b* which surround the trigger pull and serve as the track for the roller bearings. As illustrated in FIGS. 2A and 2B, the roller bearings 28 may alternatively be positioned within laterally-spaced upper and lower elongated slots 46*a*, 46*b* formed in the trigger pull. In this alternative embodiment, the roller bearings are connected to the frame's side faces 10*d*, i.e., frame-mounted roller bearings 28", such as through the bearing spindles 44, and rotate while fixed in place relative to the frame while the trigger pull and slots move relative thereto. The outer surface of the bearings preferably engages only one of the surfaces in their respective slots, top or bottom, which serve as the tracks 38 for the roller bearings.

It will be appreciated that is possible to use the trigger-mounted roller bearing configuration and frame-mounted roller bearing configuration within the same trigger pull, such as shown in FIG. 1A. In this arrangement, the frame-mounted roller bearing is in the upper portion of the trigger and the trigger-mounted roller bearing is in the lower portion. It will be appreciated that these positions could be switched. When only the trigger-mounted roller bearing is used, it is preferable to include two bearings in longitudinally spaced cavities on either the top or bottom of the trigger pull to avoid potential rocking and premature wear of the trigger pull. The roller bearing can be a ball bearing assembly, a plastic bearing wheel assembly, a needle rolling bearing assembly, a caster bearing assembly or other similar bearings. A combination of different bearings could be used in the same trigger pull, such using a DELRIN bearing wheel and ball bearing combination.

The sequence of illustrations in FIGS. 2A and 2B and FIGS. 3A-3E shows how the trigger assembly 16 operates the firing assembly 12 with a resting position 16*a*, a cocked position 16*b*, and a firing position 16*c*. These illustrations also show how the trigger pull operates the safety locking mechanism to force it into engagement with the barrel latch assembly 68 when the trigger pull is moved from the resting position to the firing position as described in more detail in the safety locking mechanism section below. The trigger assembly is preferably connected to the pivoting portion 48*a* of a sear 48 through a pivot pin 50. The trigger assembly has a bore 52 that is transverse to a section 48*b* of the sear that extends from the pivoting portion. A sear engagement spring 54 and pin 56 fit within the transverse bore. The sear spring forces the distal end of the pin outward from the opening of the transverse bore toward the sear section and bias the sear section into an engagement with the linear firing system. The trigger assembly also includes a bore 58 which is aligned with the longitudinal axis of the elongated trigger pull. A trigger return spring 34*a* and a distal end 34*b*' of a pin 34*b* fit within the bore. The proximal end 34*b*" of the pin is connected to the frame, and the spring biases the trigger pull to its rest position. The sear also has a distal end 48*c* that engages a disconnect protrusion 60 which may be shaft, tab, pin, or other extension in the frame when the firing assembly is moved to its cocked position.

In the firing-ready position and orientation of the trigger assembly, sear assembly and firing assembly, the trigger assembly engages the firing assembly through the sear and thereby moves the firing assembly from its resting position to the cocked position as the trigger pull is actuated from its rest position to its firing-ready retracted position. As indicated above, the sear engages the disconnect when the firing assembly is at the cocked position, and as the trigger assembly forces the sear further, the engagement between the sear and the disconnect forces the sear to rotate around its pivot against the sear spring force that biases the sear section into engagement with the firing assembly and causes the sear section to disengage from the firing assembly. When the trigger finger force is removed from the trigger pull, the trigger return spring and sear engagement spring respectively bias the trigger pull and the sear assembly back to their rest position where the sear section is biased back into engagement with the firing assembly.

The linear firing system 62 preferably includes the elongated firing pin assembly 12, an axial spring 64, and a housing 66. The firing pin assembly 12 includes the firing pin 12*a* and a reset spring 12*b* and has a longitudinal axis 12*c* that extends between its striking end and butt end. In the embodiment shown in FIG. 1, the firing pin has an indent between the striking end and the butt end, and the indent can be a circumferential groove around the firing pin. In the embodiment shown in FIG. 2, the firing pin has a tab between the striking end and the butt end. The tab extends from the firing pin substantially perpendicular to the longitudinal axis, and the butt end has an outer diameter that is substantially wider than a diameter of the striking end. The axial spring has one end pressed against the outer diameter of the butt end and forces the firing pin from its cocked position to its firing position. The embodiment shown in FIGS. 3 and 4 has a preloaded linear firing system.

In the preloaded linear firing system embodiment, the firing pin assembly has a reset spring 12*b* and an outer slider sleeve 12*d* or inertia piston that surrounds an internal firing pin 12*a*. As with the embodiments described above, the firing pin is biased back from the front face of the housing by the reset spring, and the forward movement of the firing pin is limited by a circumferential rim 12*e* in the pin that engages a step in the internal surface of the housing at the pin's forward-most position. The slider translates within the housing and is spring-loaded to push to a forward lip in the housing that is engaged by the front of the slider. The slider's forward-most position is limited by the lip that is separate from the step which limits the pin's forward-most position. Accordingly, the slider can be pre-loaded by its axial spring to its forward-most position while the pin is biased back from the front face away from its forward-most position. In comparison, for the embodiments described above with reference to FIGS. 1 and 2, the firing pin has a sliding element fixedly connected to the pin portion so the firing pin assembly is a single piece and there is no preloading of the firing pin.

As the sear engages the catch in the slider and draws the slider back from the lip, the pin's spring pushes the pin's rim further back into the housing past the lip. When the sear releases the slider, the slider spring forces the slider back to its forward-most position. The front of the slider impacts the backside of the pin's rim, transferring the kinetic energy of the slider to the pin and forcing the pin to its forward-most position with a force sufficient to cause the primer's ignition for the cartridge in the firing chamber. There is a space between the front of the slider and the backside of the pin's rim when both the slider and the pin are in their forward-most position. Accordingly, after the slider forces the pin forward to impact the cartridge, the pin spring biases the pin back into the housing within the hole in the housing's front face. The pin's rim is pushed back until the backside of the rim is flush against the front of the slider which is spring-biased to its forward-most position at the lip.

Although the trigger assembly is shown as it is integrated into a pistol, it will be appreciated that the trigger of the present invention can be used for different types of firearms, particularly including breech-loading pistols, shotguns and rifles. Additionally, the unique features and arrangements of the trigger's bearing track system could be used in the trigger assemblies of firearms other than breech-loading firearms.

Trigger-Actuated Safety Locking Mechanism for Barrel Latch

Another aspect of the present invention is the safety locking mechanism 18 for a spring-loaded barrel latch assembly 68 which is mounted to the frame and holds the barrel assembly 14 in its closed firing position. One end of the barrel assembly is rotatably connected to a mount 70 on the frame through a hinge or other type of pivot joint 72, such as with a takedown pin that extends through a bore extending across a pair of shoulders in the frame and a flange extending down from the barrel between the shoulders, and the breech end 14*a* of the barrel assembly can rotate around the pinned connection between an open loading position and a closed firing position. The barrel latch assembly holds the barrel assembly to the frame in the firing position by a catching engagement between the frame's barrel latch 68*a* and a catch that is connected to the barrel, such as a hook 74 on the bottom of the barrel. It will be appreciated that other catches could be used in place of a hook. The barrel latch safety locking mechanism prevents the frame's barrel latch from disengaging away from the barrel's hook while the firearm is being discharged, thereby maintaining the barrel in its closed firing position during the discharge of the ammunition and preventing an untimely opening of the barrel assembly.

The barrel latch assembly 68 includes the barrel latch 68*a*, a recess 68*b* in the frame in which the barrel latch is seated, a helical coil spring 68*c*' surrounding a spring pin 68*c*", a notch 68*d* in the bottom of the barrel latch, and a slide switch 68*e* connected to the barrel latch through an elongated rod 68*f*. The spring pin is secured to the frame at a proximal end and extends into a bore hole 82 in the barrel latch at a distal end. The spring biases the barrel latch in an extended position toward the barrel's hook. The slide switch and rod serve as a stop mechanism which prevents the spring from overextending and pushing the barrel latch's bore hole 82 off of the spring pin. The slide switch also serves as an actuator to disengage the barrel's hook from the frame's barrel latch so that the barrel assembly can rotate around a takedown pin into its open position. The barrel latch safety locking mechanism prevents the slide switch from accidentally being actuated when the trigger pull is actuated, moving from its rest position to its retracted position and the firearm is being discharged. The safety locking mechanism also prevents the barrel latch from being jerked away from its engagement with the hook due to the recoil of the firearm being discharged. Accordingly, when the trigger pull is in its rest position, a person can actuate the slide switch to push the barrel latch back, thereby releasing the hook and opening the barrel assembly. When the slide switch is moved in a longitudinal direction opposite to the spring biased extended position of the barrel latch, the latch moves back away from the barrel's hook, and the barrel is then free to rotate from the firing position to the loading position. However, when the trigger pull is in its retracted firing-ready position, the barrel latch safety locking mechanism 18 locks the barrel latch 68*a* as it is engaged with the barrel catch so that the latch cannot release the barrel catch during discharge of the firearm.

The barrel latch safety locking mechanism 18 includes a locking pin, tab or other projection 76 that fits into the notch 68*d* in the bottom surface of the barrel latch. When the locking pin is positioned within the notch, the pin prevents the latch from moving back away from the barrel's hook 74 or other catch. The safety locking mechanism also preferably includes a spring 78 and a ramp 80. In the preferred embodiment, a leaf spring 84 connects the locking pin to the frame and biases the locking pin toward the top of the trigger pull, and the ramp is formed into the top surface of the trigger pull. It will also be appreciated that the spring could alternatively be connected to the trigger pull to bias the locking pin toward the barrel latch which could have a ramped surface in the notch.

As indicated above, one of the primary benefits of the barrel latch safety locking mechanism is that it prevents the barrel from opening to the loading position from the firing position while the firearm is being discharged by preventing accidental actuation of the slide switch and preventing inertial motions of the firearm during discharge from jerking the barrel latch away from the hook. Additionally, the safety locking mechanism according to the present invention is particularly beneficial because it is actuated by the trigger pull so that the locking pin engages and secures the barrel latch in its biased engaged position with the hook as the trigger pull is retracted and the firearm is discharged. The spring-biased locking pin automatically disengages from the barrel latch and frees the slide switch when the trigger pull is in the rest position. Since the barrel latch remains in its biased engaged position with the barrel hook even when the locking pin is disengaged, a positive actuation of the slide switch while the trigger is in its resting position is also required to disengage the slide switch from the hook. Accordingly, barrel latch can only be disengaged from the hook on the bottom of the barrel when the trigger pull is in its rest position and the locking pin is disengaged from the notch in the bottom of the barrel latch (see FIG. 2A).

The operation of the barrel latch safety locking mechanism is particularly illustrated in FIGS. 3A-3E. As the trigger pull is actuated and translates rearward, the ramp in the top surface of the trigger pushes the locking pin upward against the biasing force of the leaf spring 84 into the notch (see FIGS. 3A-3D). When the trigger pull is released and is biased back to its rest position by the trigger spring, the leaf spring 84 biases the locking pin downward out of the notch (see FIG. 3E), and as indicated above while the locking pin is in this downward biased position, the trigger must be in the rest position and the barrel can be opened (FIG. 4).

The embodiments were chosen and described to best explain the principles of the invention and its practical application to persons who are skilled in the art. Various modifications could be made to the exemplary embodiments without departing from the scope of the invention, and it is intended that all matter contained herein shall be interpreted as illustrative rather than limiting. For example, although the trigger assemblies of the present invention are shown in a pistol, it will be appreciated that the invention could also be used in other types of firearms, particularly including a shotgun and a rifle. Also, although the barrel latch safety locking mechanism is actuated by a reciprocating trigger according to the embodiments described herein, firearms with a rotating trigger could use the barrel latch safety locking mechanism according to the present invention and without departing from the scope of the invention are recited in the claims directed particularly to this aspect of the invention. Thus, the breadth and scope of the present invention is not limited by the above-described embodiments but is defined in accordance with the following claims appended hereto and their equivalents.

What is claimed is:

1. A firearm, comprising:

a frame comprising a barrel latch safety locking mechanism and a mount, wherein the barrel latch safety locking mechanism comprises a barrel latch having a notch, a locking pin positioned outside the notch in a first configuration and positioned at least partially within the notch in a second configuration, and a spring;

a firing assembly situated within the frame;

a barrel assembly comprising a barrel and a catch connected to the barrel, wherein a first section of the barrel assembly is pivotally connected to the frame through the mount and a second section of the barrel assembly is releasably connected to the frame through the catch, wherein the barrel assembly rotates around the mount between an open loading orientation and a closed firing orientation, and wherein the barrel latch engages the catch when the barrel is in the closed firing orientation; and a trigger assembly operatively connected to the frame and the firing assembly, wherein the trigger assembly comprises a trigger pull having a rest position and a retracted position, wherein the trigger pull moves the locking pin from the first configuration outside the notch to the second configuration within the notch as the trigger pull is actuated from the rest position to the retracted position, and wherein the spring biases the locking pin out of the notch toward the top side of the trigger pull.

2. The firearm of claim 1, wherein the trigger assembly is further comprised of a ramp on a top side of the trigger pull, wherein the ramp is aligned with the notch when the trigger pull is in the rest position, wherein the spring is connected to the frame below the barrel latch, wherein a first end of the locking pin engages the ramp and a second end of the locking pin is disengaged from the notch when the trigger pull is in the rest position and the locking pin is in the first configuration.

3. The firearm of claim 2, wherein the spring is a leaf spring.

4. The firearm of claim 2, wherein the ramp pushes the locking pin up into the notch as the trigger pull is actuated from the rest position to the retracted position.

5. The firearm of claim 1, wherein the spring biases the barrel latch into engagement with the catch on the barrel.

6. The firearm of claim 5, wherein the catch is a hook extending downward from the barrel, wherein the barrel latch safety locking mechanism further comprises a spring pin connected to the frame, wherein the spring is situated around the spring pin, and wherein the barrel latch further comprises a bore hole into which the spring pin extends.

7. The firearm of claim 5, wherein the barrel latch safety locking mechanism further comprises a slide switch connected to the barrel latch, wherein the slide switch is biased by the spring to a first position corresponding with the barrel latch being in engagement with the catch, wherein the slide switch is actuated to a second position when the locking pin is disengaged from the notch in the first configuration, and wherein the slide switch disengages the barrel latch from the catch when in the second position.

8. The firearm of claim 1, wherein the trigger assembly further comprises a first set of roller bearings situated within the frame and positioned in an upper section of the trigger pull and a second set of roller bearings situated within the frame and positioned in a lower section of the trigger pull.

9. A firearm, comprising:

a frame comprising a barrel latch safety locking mechanism and a mount, wherein the barrel latch safety locking mechanism comprises a barrel latch having a notch and a locking pin positioned outside the notch in a first configuration and is positioned at least partially within the notch in a second configuration;

a firing assembly situated within the frame;

a barrel assembly comprising a barrel and a catch connected to the barrel, wherein a first section of the barrel assembly is pivotally connected to the frame through the mount and a second section of the barrel assembly is releasably connected to the frame through the catch, wherein the barrel assembly rotates around the mount between an open loading orientation and a closed firing orientation, and wherein the barrel latch engages the catch when the barrel is in the closed firing orientation; and a trigger assembly operatively connected to the frame and the firing assembly, wherein the trigger assembly comprises a trigger pull and a ramp on a top side of the trigger pull, wherein the trigger pull has a rest position and a retracted position, wherein the ramp is aligned with the notch when the trigger pull is in the rest position, and wherein the ramp pushes the locking pin from the first configuration outside the notch to the second configuration within the notch as the trigger pull is actuated from the rest position to the retracted position.

10. The firearm of claim 9, wherein the barrel latch safety locking mechanism is further comprised of a leaf spring connected to the frame below the barrel latch, wherein the leaf spring biases the locking pin out of the notch toward the top side of the trigger pull, wherein a first end of the locking pin engages the ramp and a second end of the locking pin is disengaged from the notch when the trigger pull is in the rest position and the locking pin is in the first configuration.

11. The firearm of claim 9, wherein the barrel latch safety locking mechanism further comprises a spring biasing the barrel latch into engagement with the catch on the barrel a slide switch.

12. The firearm of claim 11, wherein the barrel latch safety locking mechanism further comprises a slide switch connected to the barrel latch, wherein the slide switch is biased by the spring to a first position corresponding with the barrel latch being in engagement with the catch, wherein the slide switch is actuated to a second position when the locking pin is disengaged from the notch in the first configuration, and wherein the slide switch disengages the barrel latch from the catch when in the second position.

13. The firearm of claim 12, wherein the catch is a hook extending downward from the barrel, wherein the barrel latch safety locking mechanism further comprises a spring pin connected to the frame, wherein the spring is situated around the spring pin, and wherein the barrel latch further comprises a bore hole into which the spring pin extends.

14. The firearm of claim 9, wherein the trigger assembly further comprises a first set of roller bearings situated within the frame and positioned in an upper section of the trigger pull and a second set of roller bearings situated within the frame and positioned in a lower section of the trigger pull.

15. The firearm of claim 9, wherein the barrel assembly further comprises an extractor assembly situated between the barrel and the catch.

16. A firearm, comprising:

a frame comprising a barrel latch safety locking mechanism and a mount, wherein the barrel latch safety locking mechanism comprises a barrel latch, a locking pin, a leaf spring, a coil spring, and a slide switch, wherein the barrel latch has a notch and the locking pin is positioned outside the notch in a first configuration and is positioned at least partially within the notch in a second configuration;

a firing assembly situated within the frame;

a barrel assembly comprising a barrel and a catch connected to the barrel, wherein a first section of the barrel assembly is pivotally connected to the frame through the mount and a second section of the barrel assembly is releasably connected to the frame through the catch, wherein the barrel assembly rotates around the mount between an open loading orientation and a closed firing orientation, wherein the barrel latch engages the catch when the barrel is in the closed firing orientation, wherein the coil spring biases the barrel latch into engagement with the catch on the barrel, wherein the slide switch is biased by the coil spring to a first position corresponding with the barrel latch being in engagement with the catch, wherein the slide switch is actuated to a second position when the locking pin is disengaged from the notch in the first configuration, and wherein the slide switch disengages the barrel latch from the catch when in the second position; and a trigger assembly operatively connected to the frame and the firing assembly, wherein the trigger assembly comprises a trigger pull having a rest position and a retracted position, and wherein the trigger pull moves the locking pin from the first configuration outside the notch to the second configuration within the notch as the trigger pull is actuated from the rest position to the retracted position.

17. The firearm of claim 16, wherein the trigger assembly is further comprised of a ramp on a top side of the trigger pull, wherein the ramp is aligned with the notch when the trigger pull is in the rest position, wherein a first end of the locking pin engages the ramp and a second end of the locking pin is disengaged from the notch when the trigger pull is in the rest position and the locking pin is in the first configuration.

18. The firearm of claim 17, wherein the ramp pushes the locking pin up into the notch as the trigger pull is actuated from the rest position to the retracted position.

19. The firearm of claim 16, wherein the catch is a hook extending downward from the barrel.

20. The firearm of claim 16, wherein the trigger assembly further comprises a first set of roller bearings situated within the frame and positioned in an upper section of the trigger pull and a second set of roller bearings situated within the frame and positioned in a lower section of the trigger pull.

* * * * *